US009010228B2

(12) United States Patent
White et al.

(10) Patent No.: US 9,010,228 B2
(45) Date of Patent: Apr. 21, 2015

(54) BARRIER MOUNTING APPARATUS

(75) Inventors: W. Collins White, Cicero, NY (US); John Kleniatis, Jamesville, NY (US); Matthew McAllister, Springville, NY (US)

(73) Assignee: Defenshield, Inc., St. Augustine, FL (US)

( * ) Notice: Subject to any disclaimer, the term of this patent is extended or adjusted under 35 U.S.C. 154(b) by 1312 days.

(21) Appl. No.: 12/757,757

(22) Filed: Apr. 9, 2010

(65) Prior Publication Data

US 2011/0167996 A1 Jul. 14, 2011

Related U.S. Application Data

(60) Provisional application No. 61/168,080, filed on Apr. 9, 2009.

(51) Int. Cl.

| | |
|---|---|
| ***F41H 5/24*** | (2006.01) |
| ***F41H 5/08*** | (2006.01) |
| ***F41H 5/013*** | (2006.01) |
| ***F41H 5/26*** | (2006.01) |

(52) U.S. Cl.

CPC ..... *F41H 5/08* (2013.01); *F41H 5/013* (2013.01); *F41H 5/24* (2013.01); *F41H 5/26* (2013.01)

(58) Field of Classification Search

USPC ..... 248/229.1, 229.12, 229.13, 309.1, 248/316.8, 226.11, 228.3, 228.5, 235; 89/36.01, 36.02, 36.04; 52/92.1, 92.2, 52/708; 404/6

See application file for complete search history.

(56) References Cited

U.S. PATENT DOCUMENTS

| | | | | |
|---|---|---|---|---|
| 2,814,534 | A * | 11/1957 | Otani | 182/60 |
| 3,664,626 | A * | 5/1972 | Sneller | 248/224.7 |
| 3,762,345 | A | 10/1973 | Sgariglia, Jr. | |
| 3,933,346 | A | 1/1976 | Carver | |
| 4,481,729 | A * | 11/1984 | Weiller | 40/606.14 |
| 4,709,891 | A * | 12/1987 | Barnett | 248/214 |
| 5,052,850 | A | 10/1991 | Bishop | |
| 5,174,553 | A | 12/1992 | Challis | |
| D431,082 | S | 9/2000 | Jaros | |
| 6,551,011 | B1 | 4/2003 | Valentine | |
| 6,622,607 | B1 | 9/2003 | Miller | |
| 6,698,690 | B2 | 3/2004 | Novak et al. | |
| 6,907,811 | B2 | 6/2005 | White | |
| 7,069,680 | B1 * | 7/2006 | Crawford | 40/607.14 |
| 7,191,990 | B2 * | 3/2007 | Hutter, III | 248/229.12 |
| 2003/0167911 | A1 * | 9/2003 | White | 89/36.07 |
| 2005/0214066 | A1 * | 9/2005 | Lo | 403/108 |
| 2007/0193213 | A1 | 8/2007 | Nanayakkara | |
| 2007/0243015 | A1 | 10/2007 | Yodock, III et al. | |
| 2007/0296229 | A1 | 12/2007 | Chauvin et al. | |
| 2008/0271652 | A1 | 11/2008 | White et al. | |

OTHER PUBLICATIONS

International Patent Application No. PCT/US10/30588: International Search Report dated Feb. 17, 2011, 17 pages.

* cited by examiner

*Primary Examiner* — Reginald Tillman, Jr.

(74) *Attorney, Agent, or Firm* — Baker & Hostetler LLP

(57) ABSTRACT

An assembly for use in a shield includes a protective panel, protective panel securing hardware and an adjustable mount. The protective panel is ballistic-resistant and/or blast resistant. The protective panel securing hardware secures the protective panel to the adjustable mount and to extend in an upwards direction from the adjustable mount. The adjustable mount is structured and sized to be securable on top of shield bases having a plurality of alternative geometries.

53 Claims, 10 Drawing Sheets

BARRIER MOUNTING APPARATUS

CROSS REFERENCE TO RELATED APPLICATIONS

This application claims benefit to U.S. Provisional Application Ser. No. 61/168,080, filed Apr. 9, 2009, the contents of which are herein incorporated in their entirety by reference.

BACKGROUND

Law enforcement, security personnel, armed forces, and official personnel are often stationed in open areas that are subject to hostile attack. For example, security personnel may be the target of firearms, mortars, and blasts. Traditional methods of protection include digging trenches and building fortifications. Such structures are often not portable and can be time consuming to build. As a result, security personnel frequently are left exposed and vulnerable to attack for extended periods of time.

SUMMARY

Applicants disclose exemplary shield assemblies that may be used, for example, with defensive barriers. In an exemplary embodiment, a shield assembly comprises a mount that is adjustable so as to be seated on top of, and form an interference fit with, defensive barriers of varying sizes. A channel is mechanically coupled to the top of the mount and is adapted to receive a portion of a protective panel therein. The mount may be placed on top of a barrier such as, for example, a Jersey barrier and adjusted to form an interference fit with the barrier. The shield assembly mounted on top of a barrier provides protection from firearms, mortars, and blasts.

In an exemplary embodiment, the mount comprises a mount frame that is adapted to be positioned above or on top of a portion of a shield base or barrier. Hardware, which may be, for example, a channel, is mechanically coupled to a first side of the mount frame and adapted to receive a portion of a protective panel therein which extends upward relative to the mount frame. The mount may further comprise a first jaw mechanically coupled to the mount frame and extending away from a side of the mount frame opposite the channel. The mount still further comprises a second jaw mechanically coupled to the mount frame and extending away from the side of the mount frame opposite the channel. The first jaw and the second jaw form a gap therebetween for receiving a portion of a barrier. At least one of the first jaw and the second jaw is adjustably moveable relative to the other so that the gap between the two can be adjusted to correspond to barriers of varying sizes and shapes.

In an exemplary embodiment, the second jaw is moveable in one dimension relative to the first jaw. For example, the second jaw may be slidable horizontally relative to the first jaw so as to adjust the gap between the first jaw and the second jaw. The shield assembly may further comprise a fastener that is adapted to hold the first and/or second jaw in position relative to the other. In an exemplary embodiment, the fastener may comprise, for example a screw that is adjustable so as to create an interference fit between the mount frame and the first or second jaw.

In an exemplary embodiment, the second jaw is moveable in at least two dimensions relative to the mount frame and/or first jaw. For example, the second jaw may be rotatably attached to the mount frame. In an embodiment, the second jaw may be attached to the mount frame using a hinge. The second jaw is moveable around the axis of the hinge. In an embodiment, the shield assembly may further comprise a fastener that is adapted to hold the first and/or second jaw in position relative to the other. In an exemplary embodiment, the fastener may comprise, for example a screw that is adjustable so as to prevent movement of the second jaw.

Applicants further disclose shield assembly that may be mounted on a rail or similar structure. In an exemplary embodiment, the shield assembly comprises a channel and a protective panel, with a portion of the protective panel being removably received in the channel and extending up away from the channel. A first armor plate is mechanically coupled with the channel and extends below a bottom edge of the channel. A second armor plate is mechanically coupled with the channel and extends below the bottom edge of the channel substantially parallel to the first armor plate and offset relative to the first armor plate. The second armor plate and the first armor plate define a gap therebetween. The shield assembly may be mounted on a rail or similar structure by positioning the assembly on top of the rail with the rail positioned in the gap and forming an interference fit with the first and second armor plates.

This Summary is provided to introduce a selection of concepts in a simplified form that are further described below in the Detailed Description of Illustrative Embodiments. This Summary is not intended to identify key features or essential features of the claimed subject matter, nor is it intended to be used to limit the scope of the claimed subject matter. Other features are described below.

BRIEF DESCRIPTION OF THE DRAWINGS

The potential embodiments will be more fully understood and appreciated by reading the following Detailed Description in conjunction with the accompanying drawings, in which.

DETAILED DESCRIPTION OF ILLUSTRATIVE EMBODIMENTS

Figure 1:
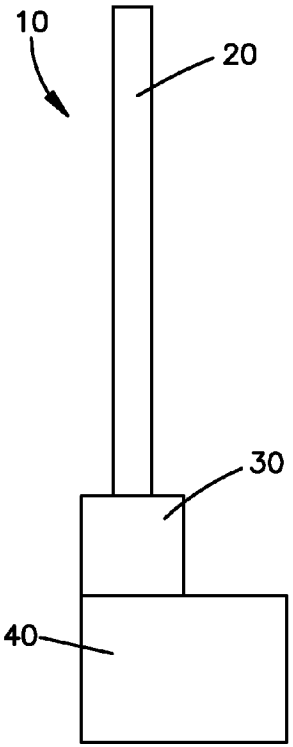
FIG. 1 is a side elevation view of an embodiment of a shield assembly.

FIG. 1 illustrates an exemplary shield assembly 10. As shown, shield assembly 10 comprises a protective panel (also referred to herein as a "shield member") 20, protective panel securing hardware 30, and an adjustable mount or "mount" 40. Adjustable mount 40 may be seated on a barrier such as, for example, a Jersey barrier. Adjustable mount 40 may be adjusted so as to be mounted on barriers of different sizes and shapes. Protective panel securing hardware 30 comprises mechanical components that are adapted to hold protective panel 20 relatively upright and substantially perpendicular to the mount. In an exemplary embodiment, securing hardware 30 comprises a channel which may comprise a u-shaped cross section which forms an interference fit with protective panel 20.

Figure 2:
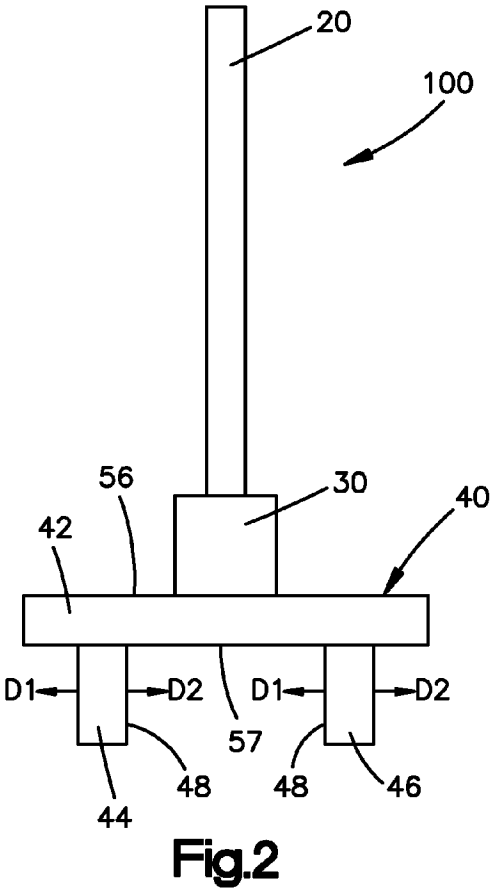
FIG. 2 is a side elevation view of an embodiment of a shield assembly.

FIG. 2 illustrates an exemplary shield assembly 100 comprising a mount that is adjustable in one dimension or direction. Shield assembly 100 comprises a protective panel 20, protective panel securing hardware 30, and an adjustable mount 40. Adjustable mount 40 comprises mount frame 42, first jaw 44, and second jaw 46. The mount frame 42 has a first side 56 and an opposing second side 57. First side 56 faces up and away from a shield base 70 (shown in FIGS. 8 and 9), e.g., a Jersey barrier, and second side 57 faces down towards and rests on top of the shield base 70 in order to support shield assembly 100 in the vertical direction. First jaw 44 and second jaw 46 are each attached to and extend away from the second side 57 of mount frame 42. The mount frame 42 connects the first and second jaws 44, 46 with the protective panel securing hardware 30. The top of a shield base 70 is clamped between the gap between the first jaw 44 and second jaw 46 in order to constrain the shield assembly 100 relative to the shield base 70 in horizontal directions and also to prevent it from tipping. The first and second jaws 44, 46 form an interference fit with the top of the shield base 70.

Figure 4:
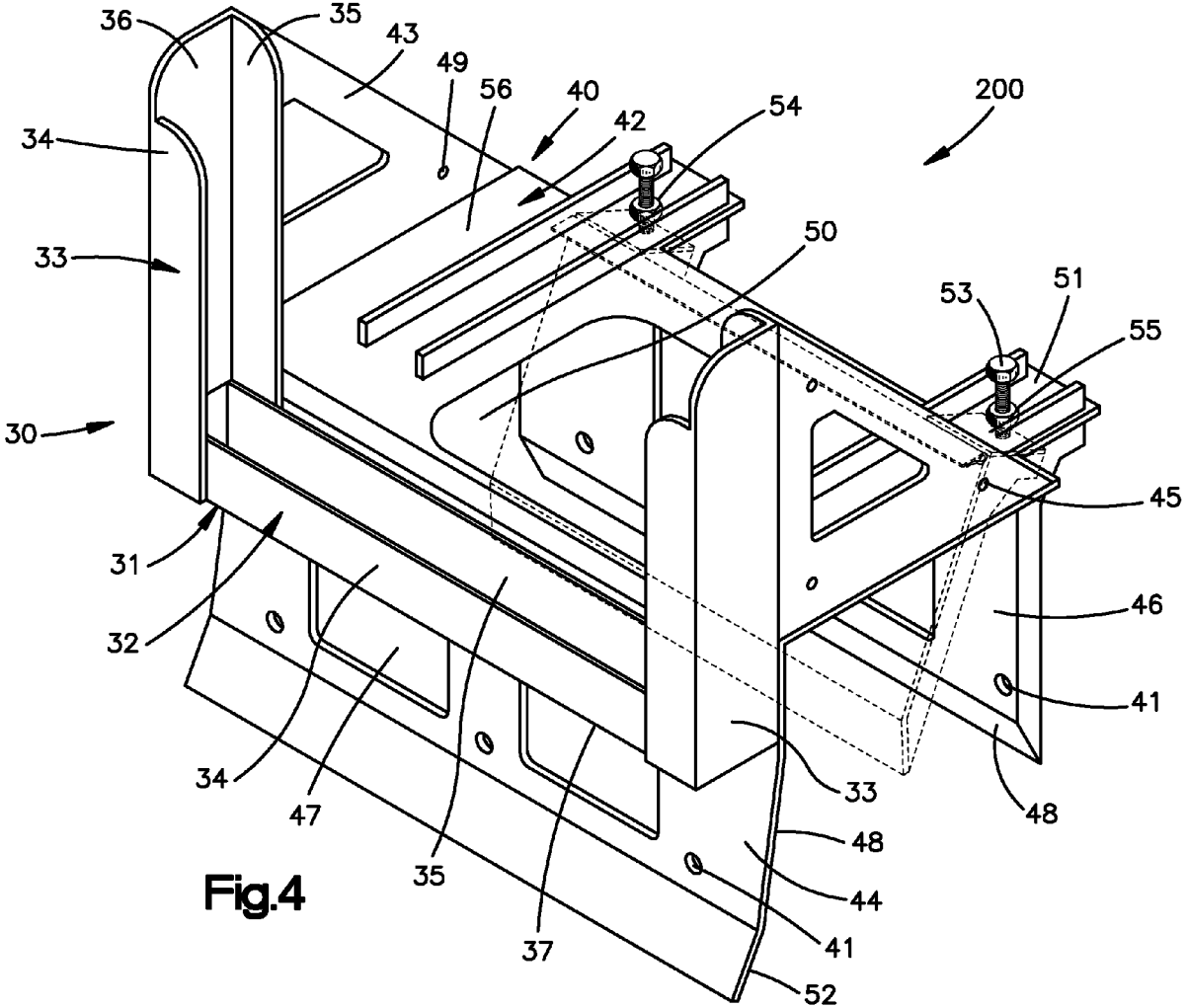
FIG. 4 is a perspective view of an embodiment of a mount and channel.

In shield assembly 100, each jaw 44, 46 can be in either a locked status or an unlocked status. When first jaw 44 or second jaw 46 is in the unlocked status, it is free to move in one dimension relative to mount frame 42 by sliding in directions D1 and D2 in order to adjust for shield bases 70 having different dimensions in the D1-D2 direction or widths. When first jaw 44 and second jaw 46 are positioned to securely clamp the top of a shield base 70 between them, then both jaws 44, 46 are placed in the locked status in order to maintain clamping pressure in the D1-D2 direction. Alternatively, one of the jaws 44, 46 can be structured to be stationary relative to mount frame 42, while the other jaw 44, 46 remains moveable in order to preserve the adjustability of mount 40. In an embodiment, the facing, clamping surfaces 48 of the jaws 44, 46 may be inclined or profiled to better correspond to the outward facing surfaces of the top portion of various shield bases 70 with which shield assembly 100 is designed for use. As illustrated in FIG. 4, clamping surfaces 48 may comprise sub-surfaces 52 where each sub-surface 52 is inclined at a different angle to correspond to the particular configuration of a shield base or barrier.

Figure 3:
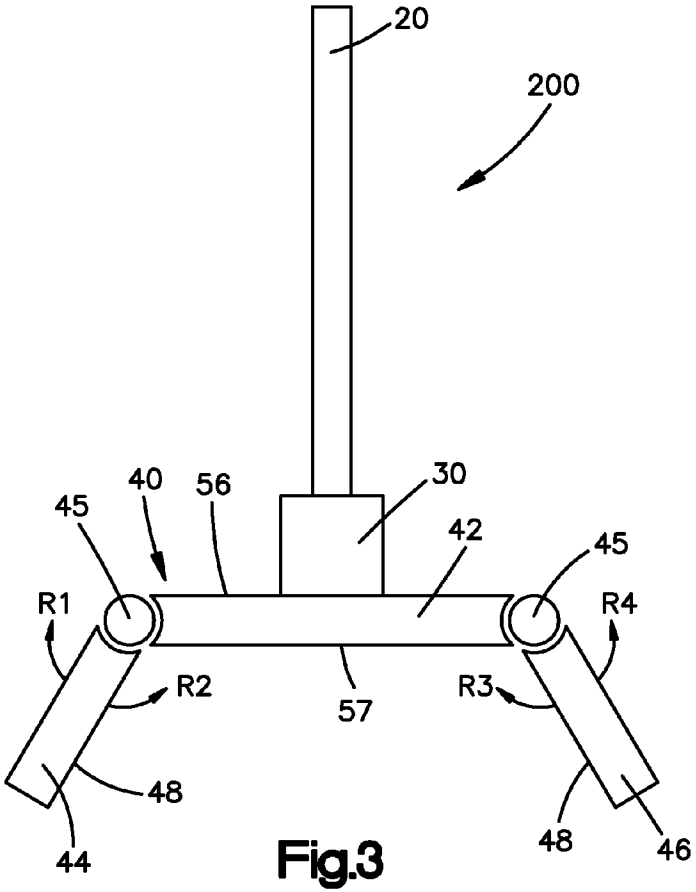
FIG. 3 is a side elevation view of an embodiment of a shield assembly.
Figure 9:
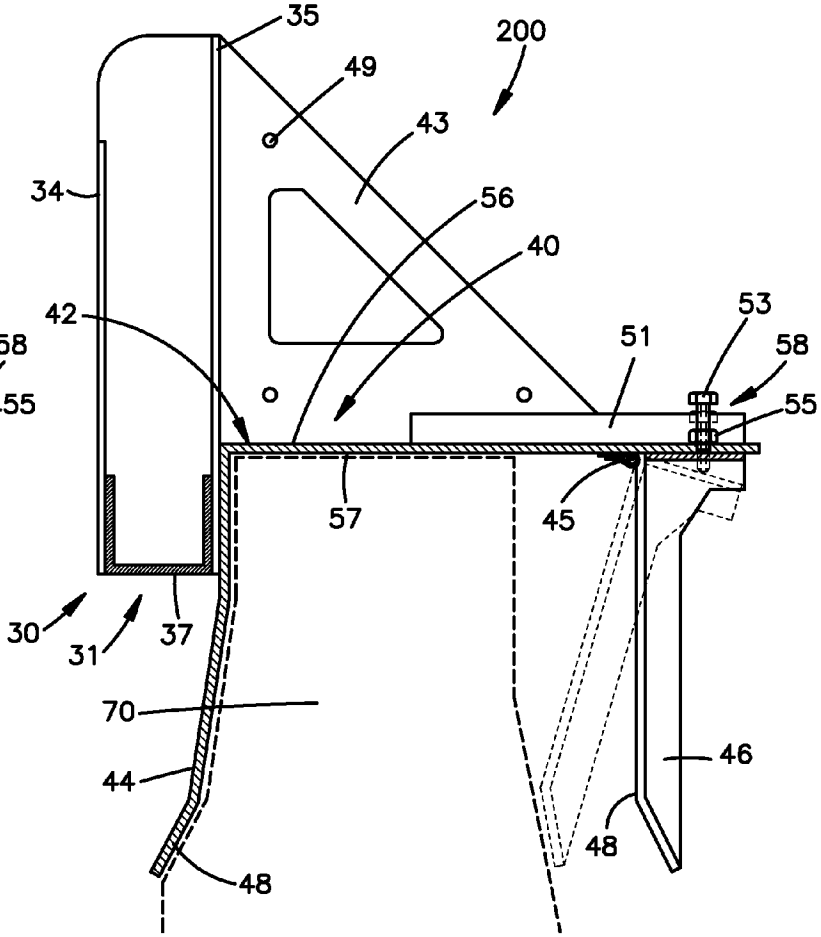
FIG. 9 is a side elevation view of an embodiment of a mount and channel on top of a shield base shown in dotted lines, wherein a second jaw of the adjustable mount is illustrated in a first position in solid lines and a second position in dotted lines.
Figure 8:
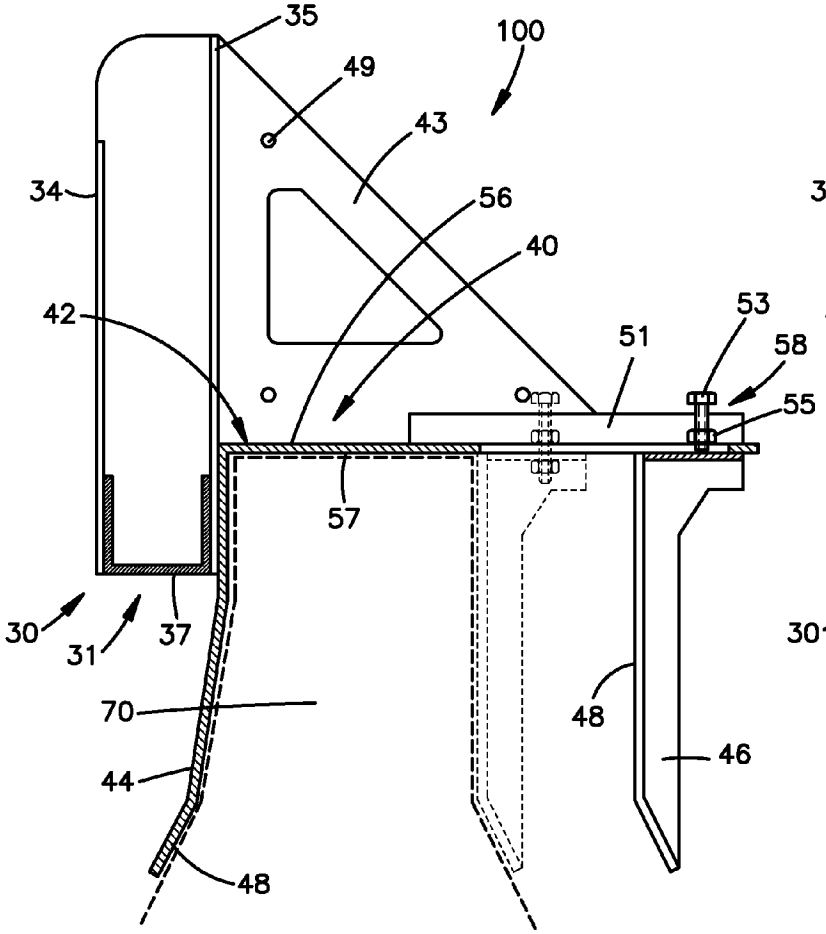
FIG. 8 is a side elevation view of an embodiment of a mount and channel on top of a shield base shown in dotted lines, wherein a second jaw of the adjustable mount is illustrated in a first position in solid lines and a second position in dotted lines.

FIG. 3 illustrates an exemplary shield assembly 200 that employs a mount that is adjustable in at least two dimensions. Shield assembly 200 comprises a protective panel 20, protective panel securing hardware 30, and an adjustable mount 40. Adjustable mount 40 comprises mount frame 42, first jaw 44, and second jaw 46. The mount frame 40 rests on top of a shield base 70 (as shown in FIGS. 8 and 9) in order to support shield assembly 200 in the vertical direction. The top of a shield base 70 is clamped between first jaw 44 and second jaw 46 to constrain the shield assembly 200 relative to the shield base 70 in horizontal directions and also to prevent it from tipping.

In the shield assembly 200, each jaw 44, 46 can be in either a locked status or an unlocked status. When a first jaw 44 is in the unlocked status it is free to move in two dimensions relative to the mount frame 42 by rotating in directions R1 and R2 about the rotational axis of a hinge 45. Second jaw 46, when in the unlocked status, is also free to move in two dimensions relative to the mount frame 42 by rotating in directions R3 and R4 about the rotational axis of another hinge 45. This rotational adjustability provides for the first and second jaws 44, 46 being adjustable for shield bases having outward facing surfaces inclined at different angles. The jaws 44, 46 may be positioned to securely clamp the top of a shield base between them. Both jaws 44, 46 may be placed in the locked status in order to maintain clamping pressure in the R1-R4 rotational directions.

In an embodiment, one of the jaws 44, 46 can be structured to be stationary relative to mount frame 42, while the other jaw 44, 46 remains rotatable in order to preserve the adjustability of mount 40. In another embodiment, one or both jaws 44, 46 may be adjustable in the D1-D2 direction (see FIG. 2) as well as rotatable in the R1-R2 and R3-R4 directions (see FIG. 3). Such a movement could be obtained by combining the sliding locking bolt 53 and rail 51 (described in greater detail below in connection with FIG. 4) with a hinge 45. In yet another embodiment, the facing, clamping surfaces 48 of the jaws 44, 46 may be inclined or profiled to better correspond to the outward facing surfaces of the top portion of various shield bases with which assembly 200 is designed for use. As illustrated in FIG. 4, clamping surfaces 48 may comprise sub-surfaces 52 where each sub-surface 52 is inclined at a different angle to correspond to a specific shield base.

Figure 6:
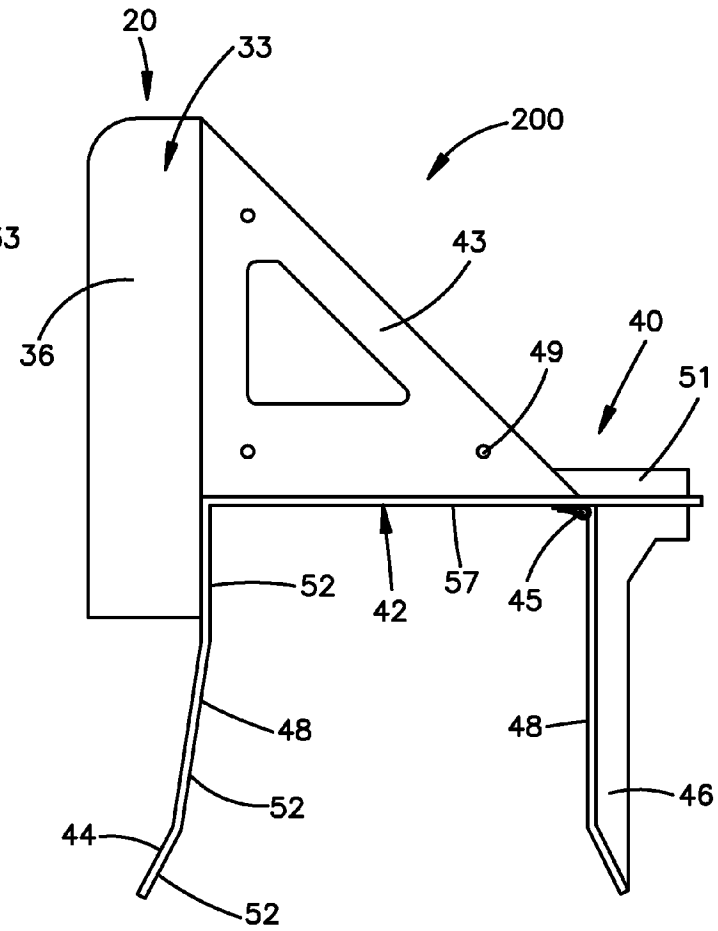
FIG. 6 is a side elevation view of an embodiment of a mount and channel.
Figure 5:
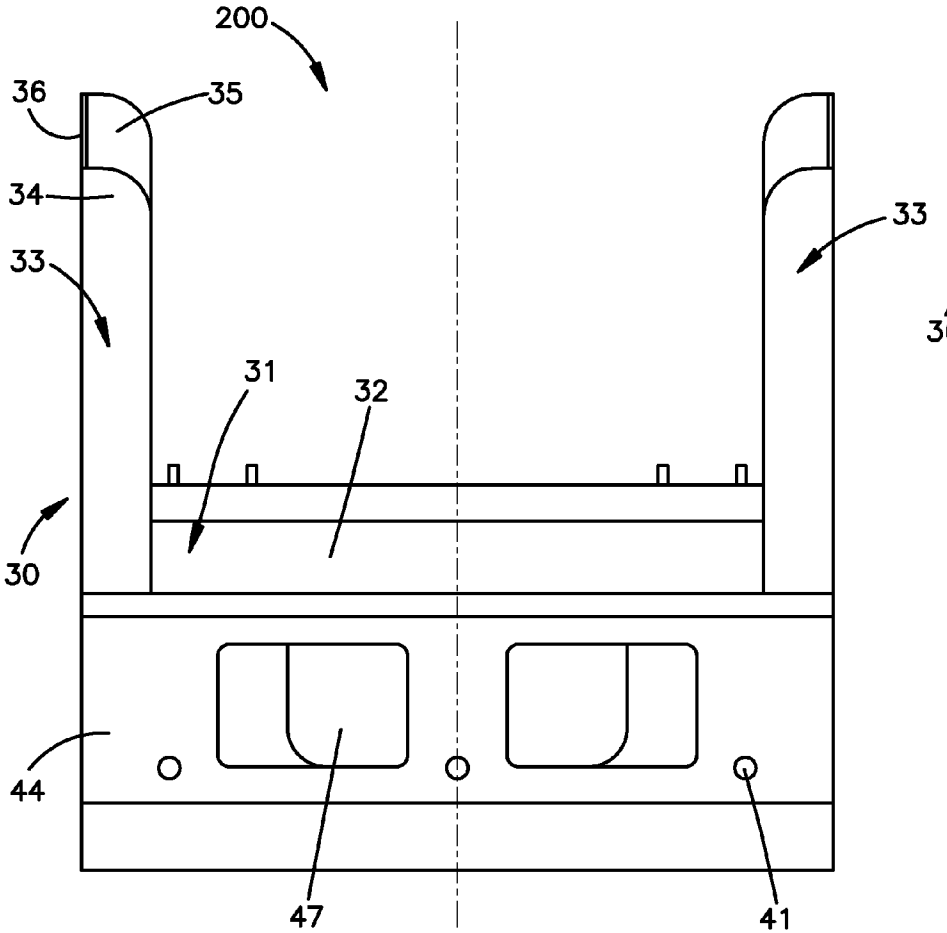
FIG. 5 is a front elevation view of an embodiment of a mount and channel.

FIGS. 4-6 illustrate various features of potential embodiments of adjustable mounts with channels. As shown, in an exemplary embodiment, securing hardware 30 may comprise a channel 31. The channel 31 may comprise, for example, a horizontal portion 32 and/or one or more vertical portions 33. Horizontal portion 32 has a front wall 34 and an opposing back wall 35 that are substantially perpendicular to the plane of mount frame 42. Horizontal portion 32 may also include a bottom wall 37 which connects front wall 34 and back wall 35. Bottom wall 37 is substantially parallel to or below the plane of mount frame 42 so as to avoid any gaps between a protective panel seated in the channel and a base or barrier on which the shield assembly is seated. Vertical portions 33 are shown containing a front wall 34, an opposing back wall 35 and a side wall 36 which connects front wall 34 and back wall 35. Each of the vertical portion front, back, and side walls 34, 35, 36 are substantially perpendicular to the plane of the mount frame 42. In an embodiment, front wall 34 is shorter than back wall 35 and thereby allows a user to more easily insert a protective panel 20 into the protective panel securing hardware 30. A user can approach the front wall 34 side of the shield assembly 200 with a protective panel 20 held substantially horizontally. Once the protective panel 20 comes into contact with the back wall 35, the user can push the protective panel 20 "up" (away from the adjustable mount 40) and it will slide into place guided by the vertical channels 33. In an exemplary embodiment, protective panel securing hardware 30 may comprise a horizontal channel 32 with no vertical channels 33. Other embodiments of the protective panel securing hardware 30 include tabs or brackets into which fasteners can be inserted in order to secure the protective panel 20 to the shield assembly 200. In one embodiment of shield assembly 200, the adjustable mount comprises at least one anchor hole 41. As illustrated in FIG. 5, anchor holes 41 may be positioned along the first jaw 44. Anchors, e.g., screws, or other fasteners may by attached to the shield base onto which the assembly 200 is mounted through the anchor holes 41 in order to provide additional stability for the shield assembly 200.

FIGS. 4-6 depict various aspects of an exemplary adjustable mount which employs a jaw movable in two dimensions. In an exemplary embodiment, adjustable mount 40 includes rails 51. Hinge 45 is attached to rail 51 and allows second jaw 46 to rotate into contact with a shield base 70 (as shown in FIGS. 8 and 9) such as a Jersey barrier. Once the second jaw 46 is in its proper position a bolt 53 or other fastener can be used to lock the second jaw 46 in place relative to mounting frame 42. Locking screw 53 (see FIG. 9) is threaded through rail 51 until it engages with the second jaw 46. In an exemplary embodiment bolt 53 passes through a washer 55 which allows the head of bolt 53 to remain accessible outside the channel of rail 51 when fully tightened down in the locked position. As shown, both first jaw 44 and second jaw 46 may comprise sub-surfaces 52 within clamping surfaces 48 so as to provide better fit with a barrier received in the gap formed between the jaws. First jaw 44 and second jaw 46 can be made of any suitable material and may be made, for example, from solid, relatively thin sheets of metal. Cutout sections 47 may be incorporated in order to reduce or minimize weight, cost and material. In one embodiment of the shield assembly, adjustable mount 40 includes a bracket 43 which connects mount frame 42 to vertical channels 33. Bracket 43 can contain gusset holes 49 which can be used to secure two shield assemblies to each other.

Figure 7:
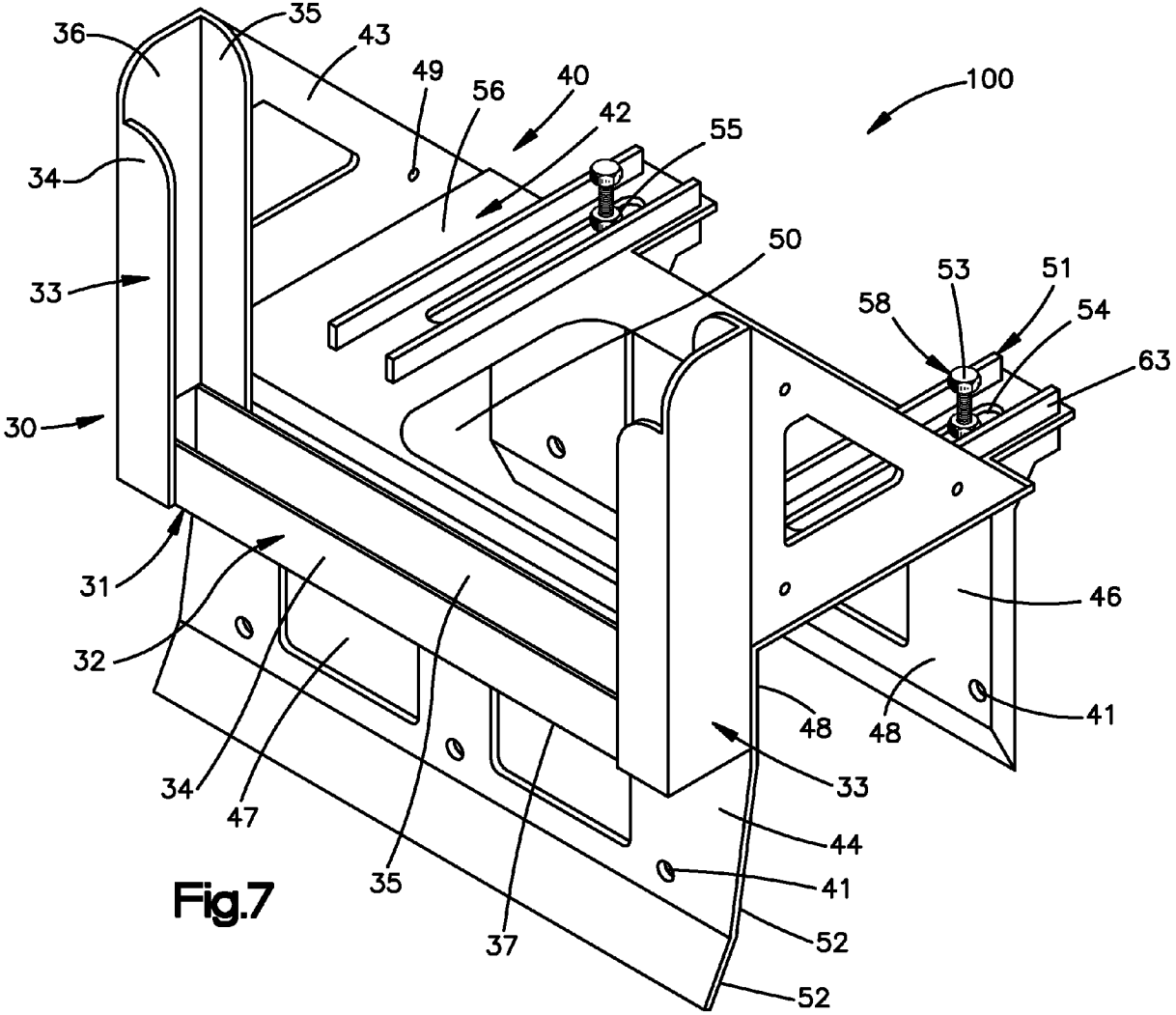
FIG. 7 is a perspective view of an embodiment of a mount and channel.

FIG. 7 depicts various aspects of an exemplary adjustable mount which employs a jaw movable in one dimension. Mount frame 42 includes at least one rail 51. Rail has a recess 54 formed therein through which an adjustable member 58 of the first and/or second jaws 44, 46 may extend. Rail 51 may additionally include ribs 63 for added rigidity. This adjustable member 58 is adapted to create an interference fit between the second jaw 46 and the mount frame 42. Adjustment member 58 can be a fastener such as, for example, a bolt, screw, anchor, nail, etc. In the embodiment depicted in FIG. 7, adjustment member 58 comprises a bolt 53 that passes down through the recess 54 and into the second jaw 46. Mount frame 42 can include multiple rails 51 in parallel to each other. Adjustment member 58 can remain loose while the second jaw 46 is being positioned against the shield base. Once the second jaw 46 is in the desired position, bolt 53 is tightened in order to secure or lock the second jaw 46 into place relative to the first jaw 44 and mount frame 42. While described in terms of the second jaw 46 being moveable and the first jaw 44 being stationary compared to the mount frame 42, one skilled in the art will recognize that the first jaw 44 can be used in the same manner as described above while the second jaw 46 remains fixed. Alternatively, both the first jaw 44 and the second jaw 46 can be moveable and lockable as described above.

FIG. 8 illustrates the operation of the adjustable mount 40 and movement of first jaw 44 and second jaw 46 in shield assembly 100. As shown, bolt 53 passes through recess 54 in rail 51 and engages with second jaw 46. Adjustable mount 40 may be placed on top of a shield base 70 such as, for example, a Jersey barrier. The first jaw 44 and second jaw 46 are then pushed towards each other, causing bolt 53 to ride along rail 51 until the clamping surfaces 48 of the first jaw 44 and second jaw 46 contact the shield base 70 or barrier. Bolt 53 is then tightened down preventing further movement of the first jaw 44 and second jaw 46 and securing the shield assembly 100 to the shield base 70.

FIG. 9 illustrates the operation of the adjustable mount 40 and movement of first jaw 44 and second jaw 46 in shield assembly 200. As shown, hinge 45 is connected to rail 51 and rotationally engages with second jaw 46. In an alternative embodiment both first jaw 44 and second jaw 46 are rotationally connected to the mount frame 42 by a hinges 45. Adjustable mount 40 may be placed on top of a shield base 70 such, for example, a Jersey barrier. In the depicted embodiment, the first jaw 44, if fixed and not rotatable, is placed against the outer surface of a shield base 70 and second jaw 46 is then rotated towards the first jaw 44 until the clamping surfaces 48 of the first jaw 44 and second jaw 46 contact the shield base 70. Bolt 53 is then tightened down preventing further movement of the first jaw 44 and second jaw 46 and securing the shield assembly 200 to the shield base 70. As illustrated in FIG. 9, in an exemplary embodiment, bottom wall 37 of channel 31 is situated below mount frame 42. Accordingly, when (as shown in FIG. 10) a protective panel is positioned in channel 31, there is overlap between the protective panel and the mount frame 42 which prevents gaps between protective panel 20 and a shield base or barrier 70 when the shield assembly 100/200 is mounted on the barrier 70.

Figure 10:
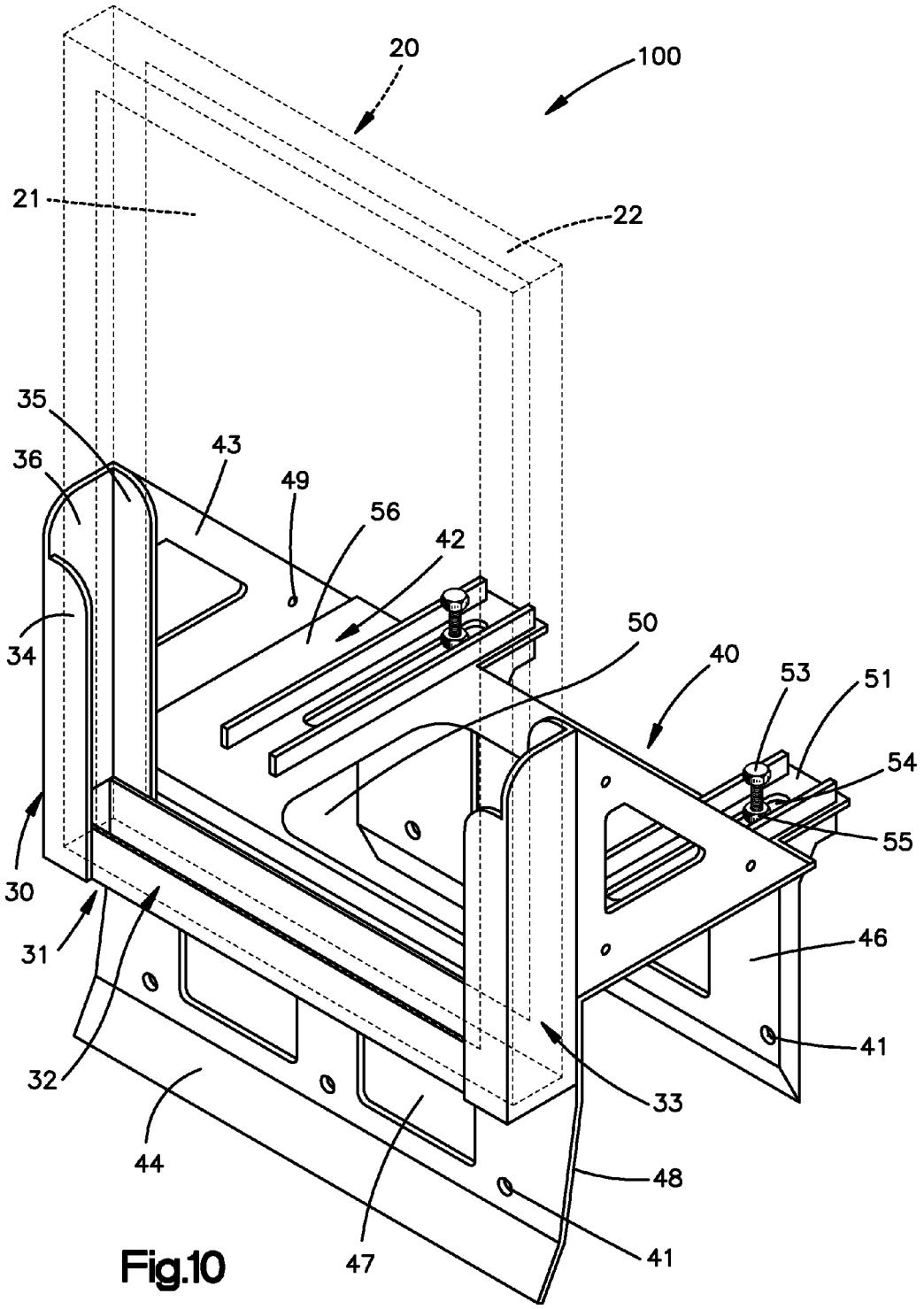
FIG. 10 is a perspective view of an embodiment of a shield assembly, showing the position of the protective panel in dotted lines.
Figure 12:
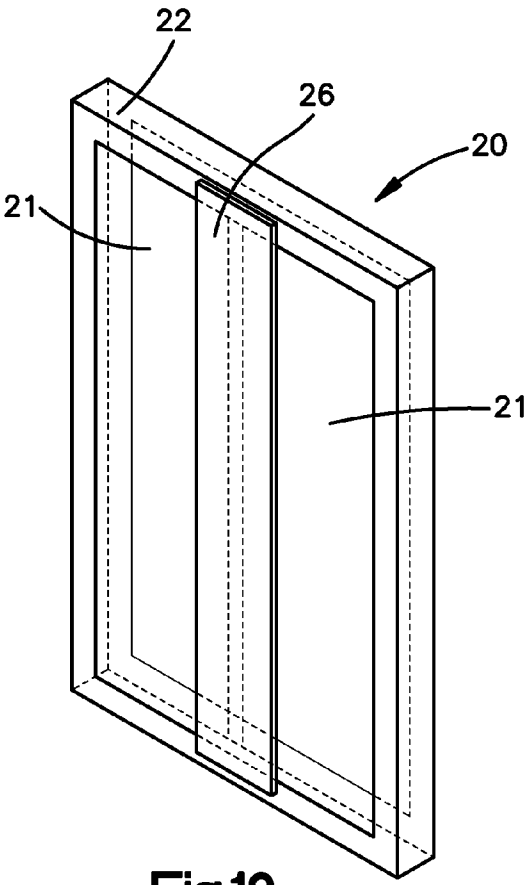
FIG. 12 is a perspective view of a protective panel with multiple sections and an armor strip covering the seam between the two sections.

In FIG. 10 an embodiment of the shield assembly 100 is shown with the protective panel 20 in dotted lines. Protective panel 20 is portable and easily replaceable. The protective panel 20 may be a single unitary piece of attack-resistant pane 21 made of a transparent material such as glass (attack-resistant refers to projectiles, ballistics, and blasts), but may alternatively comprise other pieces, such as a metal frame 22. Metal frame 22 may be a generally cross sectional U-Shaped frame extending around one or more edges of pane 21. Protective panel 20 may alternatively include a gasket layer (not shown). The gasket layer can be made of a rubber layer positioned between the pane 21 and metal frame 22 or may be applied directly to pane 21. The protective panel 20 can be installed and replaced independently of the rest of the shield assembly 100, 200. To assist in handling and placement of protective panel 20, a gripping member or arm 27 may be rigidly mechanically attached to protective panel 20 (see FIG. 16).

Figure 13:
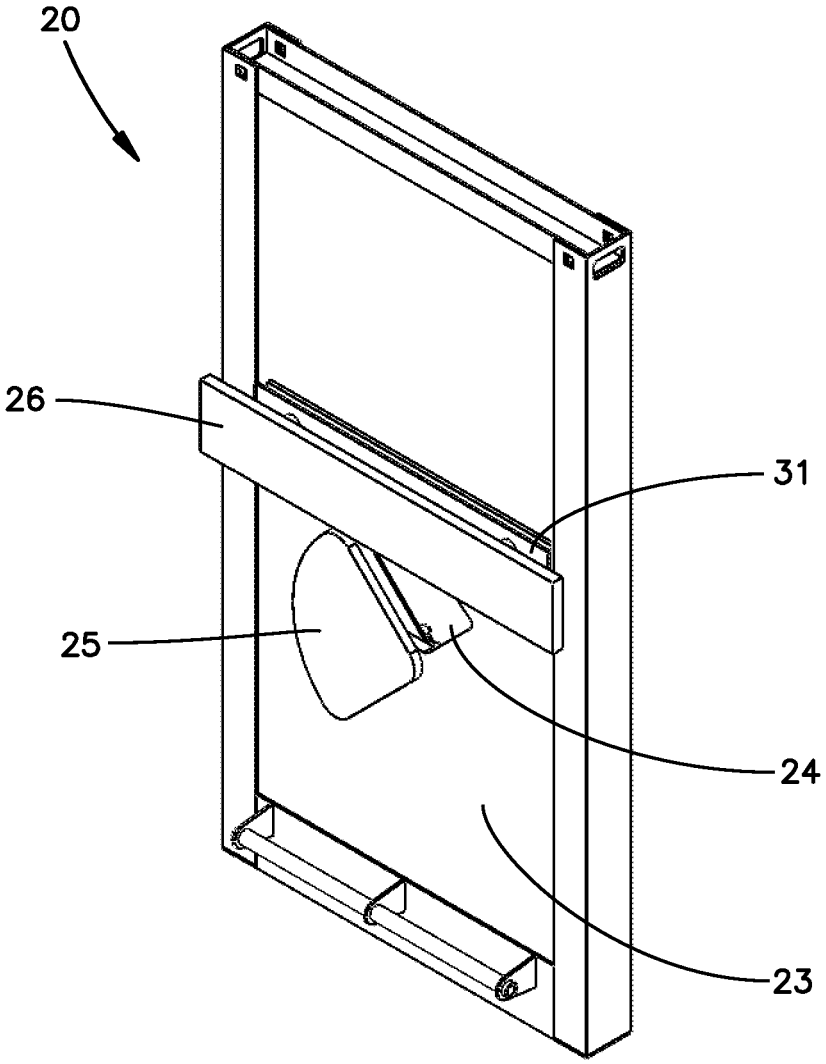
FIG. 13 is a perspective view of a protective panel with a top attack-resistant pane section and a bottom armor portion including a weapon port.

As illustrated in FIG. 13, protective pane 20 may contain an armor section 23 as a total or partial replacement for the attack-resistant pane 21. In an exemplary embodiment, armor section 23 may be opaque. In a further embodiment protective panel 20 includes multiple sections that include a combination of one or more attack-resistant glass sections and/or armor sections. In yet another embodiment, an armor section 23 may contain a weapon port 24. Weapon port 24 may be sized large enough to allow a gun barrel to project through the armor while allowing room to maneuver. A weapon port cover 25 is operatively attached to the armor section 23 allowing a person behind the protective panel 20 to open or close the weapon port 24 when in use.

Figure 11:
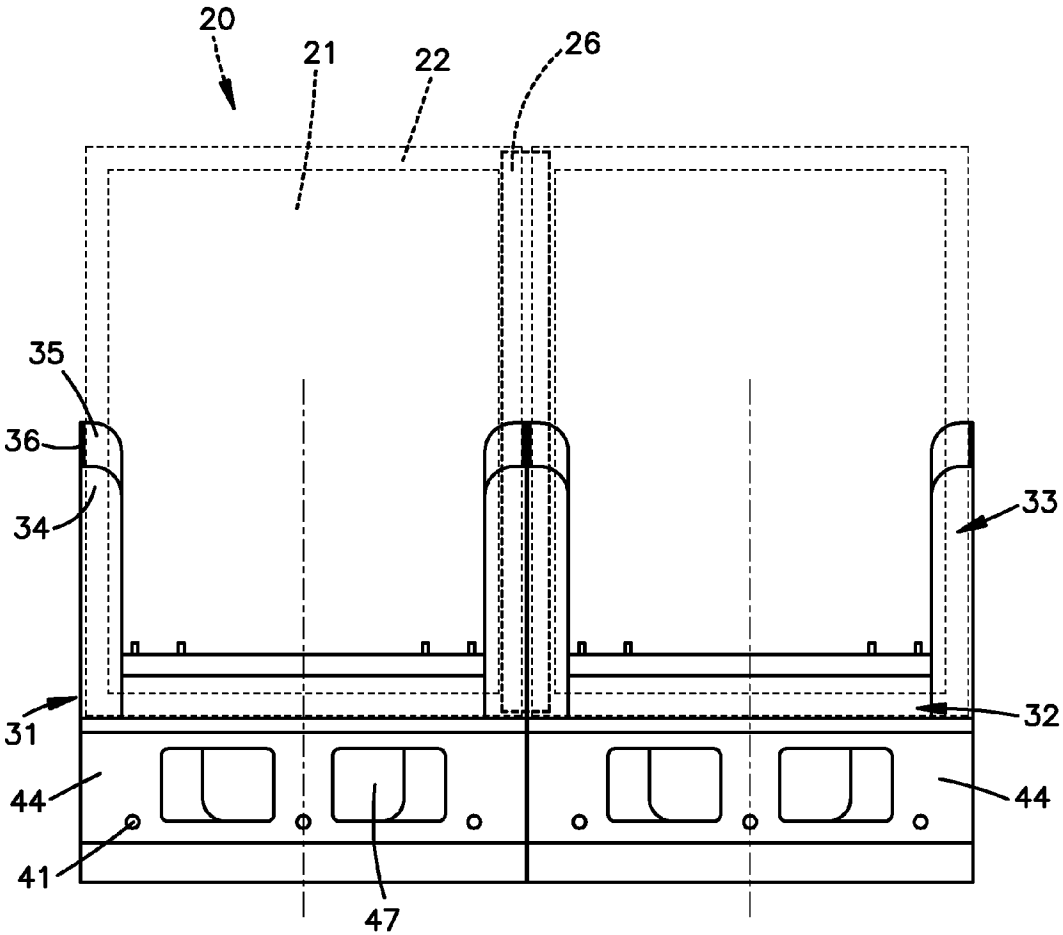
FIG. 11 is a front elevation view of two shield assemblies positioned in series with protective panel and an armor strip shown in dotted lines.

As illustrated in FIG. 11, multiple shield assemblies 100, 200 can be assembled in series to provide wider coverage. Fasteners such as but not limited to bolts, screws, and zip-ties can be placed through gusset holes 49 which are included preferably on bracket 43, but alternatively may be formed on any outer surface of the shield assembly 100, 200.

Figure 14:
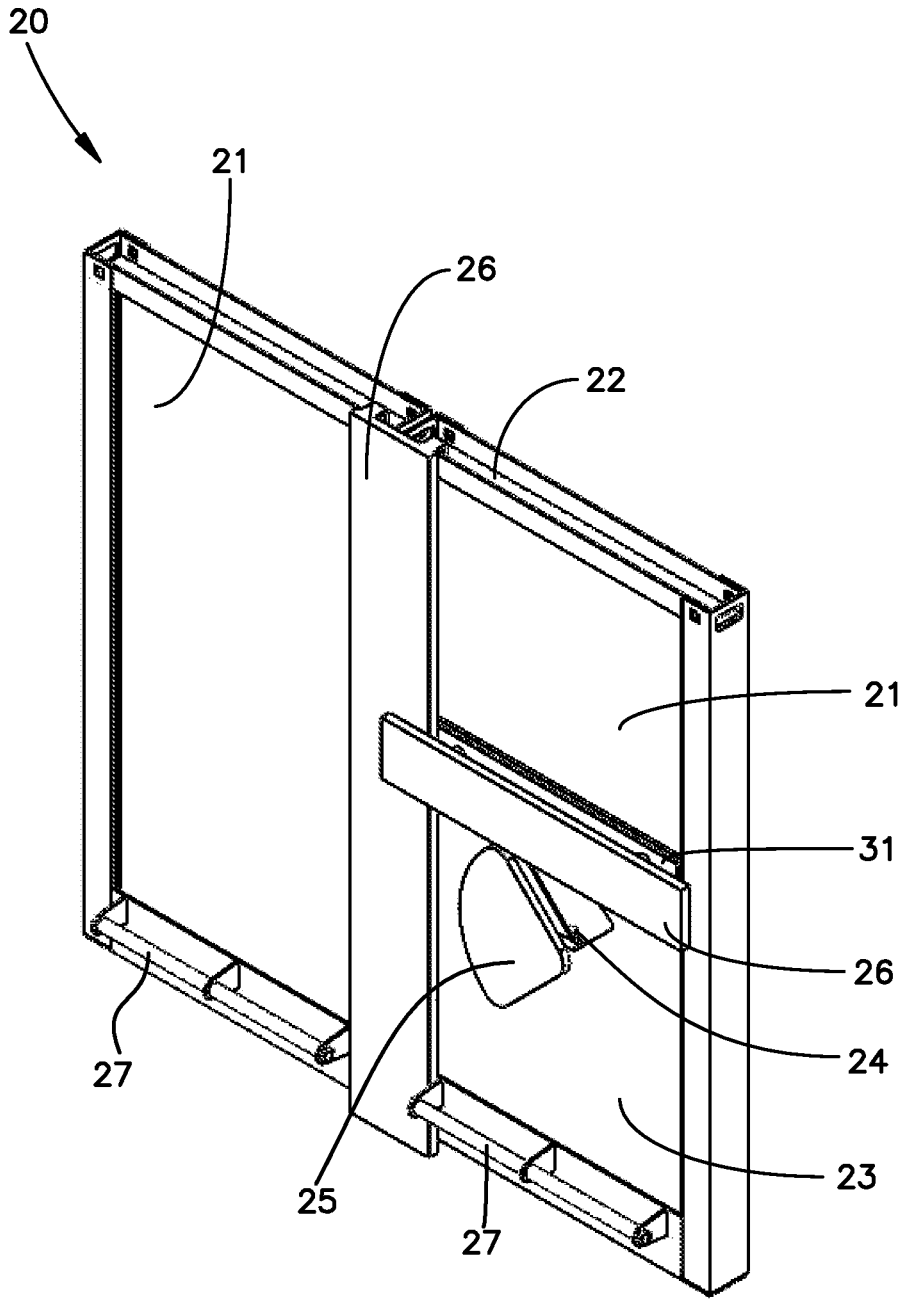
FIG. 14 is a perspective view of two protective panels positioned side-by-side with one of the protective panels comprising a top attack-resistant pane section and a bottom armor portion including a weapon port, wherein the seams between the various sections and between the protective panels are covered by armor strips.

Referring to FIGS. 11-14, an armor strip 26 may be employed to covers gaps between assemblies 100, 200 or seams between different sections within a protective panel 20. Referring to FIG. 14, a protective panel 20 comprises two attack-resistant pane sections 21 and an armor section 23 with a weapon port 24. One armor strip 26 is oriented vertically and covers the edges of adjacent sections 21, 23 and a second armor strip 26 is oriented horizontally and covers the edges of adjacent sections 21, 23 as well as the edge of the vertical armor strip 26.

Figure 16:
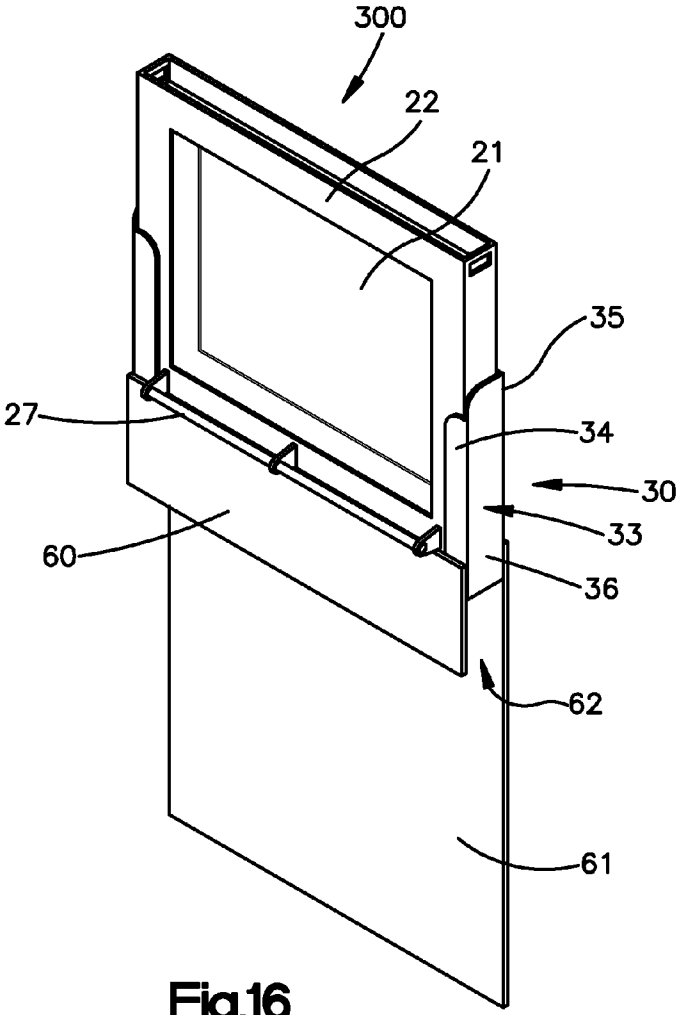
FIG. 16 is a perspective view of a shield assembly.
Figure 15:
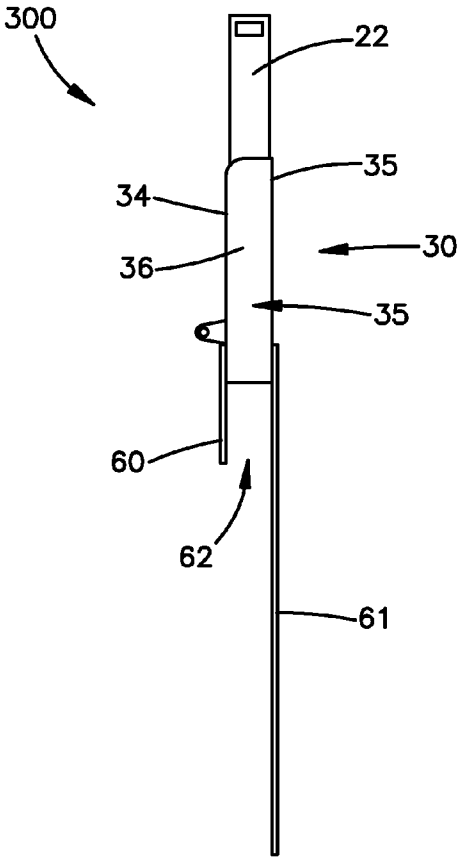
FIG. 15 is a side elevation view of a shield assembly.

Applicants have developed shield assemblies that are suitable for mounting on various types of bases. FIGS. 15 and 16 depict a shield assembly 300 embodiment that may be suitable, for example, for mounting on a rail or other relatively thin structure. As illustrated, shield assembly 300 comprises a channel 30 which may be a U-shaped channel as described above. Channel 30 may comprise horizontal portion (as depicted above in connection with FIG. 10) and, optionally, one or more vertical portions 33. Protective panel 20 is received in the horizontal (first) portion 32 and the vertical (second) portion 33. Protective panel 20 is removably received in the channel 30 and extends upward and away from channel 30. Protective panel 20 can include any combination of the attack-resistant pane 21, metal frame 22, armor section 23 and weapon port 24 with cover 25 as described above in reference to other embodiments. Additionally, an embodiment of protective panel 20 can include gripping member 27 which is attached to an outer edge, preferably a bottom edge of protective panel 20 to facilitate installation and removal of protective panel 20. If protective panel 20 includes more than one section or material, armor strips 26 can be used to cover seams between sections.

A first armor plate 60 is mechanically coupled to channel 30 and extends downward below a bottom edge of channel 30. A second armor plate 61 is mechanically coupled to channel 30 and extends downward below the bottom edge of channel 30. Second armor plate 61 can be longer and extend substantially farther downward then first armor plate 60. Alternatively, first and second armor plates 60, 61 may be of equal length. First and second armor plates 60, 61 extend substantially parallel to each other with an offset between them which defines a gap 62. In one embodiment, shield assembly 300 may include a railing (such as, but not limited to, a hand rail, not shown) which receives gap 62. Shield assembly 300 is positioned on top of the railing with the armor plates 60 and 61 forming an interference fit with the railing. Shield assembly 300 may further comprise a tether (not shown) which may be coupled to a railing and the protective panel 20 in order to securely position shield assembly 300 relative to the railing.

Thus, Applicants have disclosed various embodiments of shield assemblies that are adapted to be used on mounting apparatuses of various sizes and configurations. The disclosed embodiments are relatively quick to assemble, easy to repair, and adaptable to a number of base support members with different sizes and shapes.

The foregoing description is provided for the purpose of explanation and is not to be construed as limiting the potential embodiments. While the embodiments have been described with reference to preferred embodiments or preferred methods, it is understood that the words which have been used herein are words of description and illustration, rather than words of limitation. Furthermore, although the potential embodiments have been described herein with reference to particular structure, methods, and embodiments, the potential embodiments are not intended to be limited to the particulars disclosed herein, as the potential embodiments extend to all structures, methods and uses that are within the scope of the appended claims. Further, several advantages have been described that flow from the structure and methods; the potential embodiments are not limited to structure and methods that encompass any or all of these advantages. Those skilled in the relevant art, having the benefit of the teachings of this specification, may effect numerous modifications to the potential embodiments as described herein, and changes can be made without departing from the scope and spirit of the potential embodiments as defined by the appended claims. Furthermore, any features of one described embodiment can be applicable to the other embodiments described herein.

What is claimed:

1. A shield assembly, comprising:

a mount frame including a first side and a second side that is spaced from the first side along a vertical direction, the mount frame adapted to be positioned atop a barrier such that the second side faces the barrier and the first side faces away from the barrier;

a channel coupled to the mount frame, the channel adapted to receive a portion of a protective panel therein, the channel including a bottom wall with a surface which supports the protective panel in the vertical direction when the channel receives the portion of the protective panel;

a first jaw mechanically coupled to the mount frame and extending along the vertical direction away from the second side of the mount frame such that a portion of the first jaw is positioned below the surface of the bottom wall along the vertical direction such that the surface is closer to the second side than the portion of the first jaw is to the second side with respect to the vertical direction; and a second jaw mechanically coupled to the mount frame and extending away from the second side of the mount frame, the first jaw and second jaw forming a gap therebetween for receiving a portion of the barrier, the second jaw being moveable relative to the first jaw;

wherein the channel is coupled to the mount frame such that a straight line oriented perpendicular to the vertical direction passes through each of the surface of the bottom wall, the first jaw, and the second jaw.

2. The shield assembly as recited in claim 1, wherein at least one of the first jaw and the second jaw is moveable relative to the mount frame to adjust the size of the gap and thereby form an interference fit with the barrier.

3. The shield assembly as recited in claim 2, further comprising a fastener mechanically interfacing with at least one of the first jaw and the second jaw, the fastener securing the position of at least one of the first jaw and the second jaw relative to the other.

4. The shield assembly as recited in claim 1, wherein the first jaw is fixed relative to the mount frame.

5. The shield assembly as recited in claim 4, further comprising a fastener mechanically interfacing with the second jaw, the fastener adapted to secure the second jaw relative to the first jaw.

6. The shield assembly as recited in claim 1, wherein the first jaw is movable relative to the mount frame and the second jaw is movable relative to the mount frame.

7. The shield assembly as recited in claim 6, further comprising:

a first fastener mechanically interfacing with the first jaw and adapted to secure the first jaw relative to the mount frame; and a second fastener mechanically interfacing with the second jaw and adapted to secure the second jaw relative to the mount frame.

8. The shield assembly as recited in claim 1, wherein the second jaw is moveable in one dimension relative to the mount frame.

9. The shield assembly as recited in claim 8, further comprising a fastener mechanically interfacing with the second jaw and adapted to secure the second jaw relative to the mount frame.

10. The shield assembly as recited in claim 1, wherein the second jaw is moveable in a horizontal direction relative to the first jaw, the horizontal direction being perpendicular to the vertical direction.

11. The shield assembly as recited in claim 10, wherein the second jaw and the first jaw each is moveable in the horizontal direction relative to the mount frame.

12. The shield assembly as recited in claim 1, wherein the mount frame has a recess formed therein and a portion of the second jaw extends through the recess and is moveable within the recess so as to adjust the gap formed between the second jaw and the first jaw.

13. The shield assembly as recited in claim 12, wherein the portion of the second jaw that extends through the recess comprises an adjustable member adapted to create an interference fit between the second jaw and the mount frame.

14. The shield assembly as recited in claim 13, wherein the adjustable member comprises a screw.

15. The shield assembly as recited in claim 1, wherein the second jaw is moveable in two dimensions relative to the mount frame.

16. The shield assembly as recited in claim 15, further comprising a fastener mechanically interfacing with the second jaw and adapted to secure the second jaw relative to the mount frame.

17. The shield assembly as recited in claim 1, wherein the second jaw is moveable in two dimensions relative to the mount frame and the first jaw is moveable in two dimensions relative to the mount frame.

18. The shield assembly as recited in claim 1, wherein the second jaw is rotatable around an axis relative to the mount frame.

19. The shield assembly as recited in claim 15, further comprising a hinge mechanically coupled to the mount frame and to second jaw, the second jaw rotatable relative to the mount frame around the hinge.

20. The shield assembly as recited in claim 19, further comprising an adjustable member adapted to hold the second jaw in position relative to the mount frame around the hinge.

21. The shield assembly as recited in claim 20, wherein the adjustable member comprises a screw and the mount frame has a recess formed therein, the screw extending through the recess and abutting the second jaw.

22. The shield assembly as recited in claim 1, further comprising:

a first hinge mechanically coupled to the mount frame and to the first jaw, the first jaw rotatable relative to the mount frame around the first hinge; and a second hinge mechanically coupled to the mount frame and to the second jaw, the second jaw rotatable relative to the mount frame around the second hinge.

23. The shield assembly as recited in claim 22, further comprising:

a first adjustable member adapted to position the first jaw relative to the mount frame around the around hinge; and a second adjustable member adapted to position the second jaw relative to the mount frame around the second hinge.

24. The shield assembly as recited in claim 23, wherein the first adjustable member comprises a first screw and the mount frame has a first recess formed therein, the first screw extending through the first recess and abutting the first jaw, and wherein the second adjustable member comprises a second screw and the mount frame has a second recess formed therein, the second screw extending through the second recess and abutting the second jaw.

25. The shield assembly as recited in claim 1, wherein the channel has a substantially u-shaped cross section.

26. The shield assembly as recited in claim 1, wherein the channel comprises a first portion extending approximately parallel to the mount frame and at least a second portion extending approximately perpendicular to the mount frame.

27. The shield assembly as recited in claim 26, further comprising a protective panel, a portion of the protective panel received in the first portion of the channel and a portion of the protective panel received in the second portion.

28. The shield assembly as recited in claim 27, wherein the first portion has a u-shaped cross section and the second portion has a u-shaped cross section.

29. The shield assembly as recited in claim 27, wherein the protective panel is removable from the channel.

30. The shield assembly as recited in claim 1, further comprising a protective panel, the protective panel received into the channel and upstanding relative to the mount frame.

31. The shield assembly as recited in claim 30, wherein the protective panel is resistant to at least one of projectiles, ballistics, and blasts.

32. The shield assembly as recited in claim 30, wherein the protective panel comprises a metal frame, the metal frame being received in the channel.

33. The shield assembly as recited in claim 30, wherein the protective panel comprises a gasket, the gasket being received in the channel.

34. The shield assembly as recited in claim 30, wherein the protective panel comprises a first portion comprised of armor and a second portion comprised of a translucent ballistic resistant material.

35. The shield assembly as recited in claim 30, further comprising an armor strip, the armor strip positioned over a joint between the first portion and the second portion of the protective panel.

36. The shield assembly as recited in claim 1, further comprising a shield base, wherein the mount frame is seated above a portion of the base and the portion of the base is received in the gap formed between the first jaw and the second jaw.

37. The shield assembly as recited in claim 36, wherein the first jaw forms and interference fit with the base and the second jaw forms an interference fit with the base.

38. The shield assembly as recited in claim 36, wherein the shield base is a Jersey barrier.

39. The shield assembly as recited in claim 1, further comprising a side wall extending away from the mount frame, the side wall having a recess formed therein, the recess adapted to connect the shield assembly to another shield assembly.

40. The shield assembly as recited in claim 30, wherein the protective panel comprises a grip member, the grip member adapted to be gripped while handling the protective panel.

41. The shield assembly as recited in claim 1, wherein at least one of the first jaw and the second jaw has a recess formed therein for receiving a fastener adapted to secure the shield assembly relative to a base.

42. A shield assembly, comprising:

a mount structured to be received on a base, the mount defining a gap for receiving a portion of the base, the mount being adjustable to modify the gap, the mount including;

a) a mount frame including a first side, a second side that is spaced from the first side along a vertical direction, and a recess that extends from the first side through the second side, wherein the second side faces the base and the first side faces away from the base when the mount is received on the base;

b) a first jaw mechanically coupled to the mount frame such that the first jaw is in a fixed position and orientation with respect to the mount frame, the first jaw including a clamping surface that partially defines the gap and faces the base when the mount is received on the base, and an outer surface that faces away from the base when the mount is received on the base; and c) a second jaw including an adjustable member, the second jaw mechanically coupled to the mount frame by the adjustable member which extends through the first side, the second side, and the recess at the first side, the first jaw spaced from the second jaw in a horizontal direction that is perpendicular to the vertical direction, the second jaw including a clamping surface that partially defines the gap and faces the base when the mount frame is received on the base, the second jaw being translatable relative to both the mount frame and the first jaw along the horizontal direction, wherein the clamping surface of the second jaw is positioned closer to the clamping surface of the first jaw than the adjustable member is positioned to the clamping surface of the first jaw with respect to the horizontal direction; and a channel coupled to the mount, the channel including a bottom wall having a surface, the channel adapted to receive a portion of a protective panel therein such that the surface is configured to support the protective panel in the vertical direction.

43. The shield assembly as recited in claim 42, wherein the mount is adjustable to modify the gap to be conducive to receiving a base having a first geometry or a second geometry.

44. The shield assembly as recited in claim 42, wherein the fastener comprises a screw that is adjustable to create an interference fit between the second jaw and the mount frame.

45. The shield assembly as recited in claim 42, wherein the second jaw is moveable in at least two dimensions relative to the first jaw.

46. The shield assembly as recited in claim 42, wherein the second jaw is rotatable around an axis.

47. The shield assembly as recited in claim 42, wherein the mount further comprises a mount frame and a hinge, the hinge mechanically coupled to the mount frame and the second jaw, the second jaw rotatable relative to the mount frame around the hinge.

48. The shield assembly as recited in claim 42 wherein the channel is coupled to the mount such that the channel is positioned closer to the outer surface of the first jaw than the channel is positioned to the clamping surface of the first jaw with respect to the horizontal direction.

49. The shield assembly as recited in claim 48, wherein the channel is positioned below the mount frame with respect to the vertical direction such that the surface of the bottom wall is closer to the second side than the surface of the bottom wall is to the first side.

50. The shield assembly as recited in claim 48, wherein the first jaw extends in the vertical direction away from the second side of the mount frame such that a portion of the first jaw is positioned below the surface of the bottom wall along the vertical direction such that the surface is closer to the second side than the portion of the first jaw is to the second side.

51. A shield assembly, comprising:

a mount frame adapted to be positioned atop a barrier;

a channel coupled to a first side of the mount frame, the channel adapted to receive a portion of a protective panel therein;

a first jaw mechanically coupled to the mount frame and extending away from a second side of the mount frame;

a second jaw mechanically coupled to the mount frame and extending away from the second side of the mount frame, the first jaw and second jaw forming a gap therebetween for receiving a portion of the barrier, the second jaw being moveable relative to the first jaw;

a hinge mechanically coupled to the mount frame and to the second jaw, such that the second jaw is rotatable relative to the mount frame around the hinge; and an adjustable member adapted to hold the second jaw in position relative to the mount frame around the hinge;

wherein the second jaw is moveable in two dimensions relative to the mount frame.

52. The shield assembly as recited in claim 51, wherein the adjustable member comprises a screw and the mount frame has a recess formed therein, the screw extending through the recess and abutting the second jaw.

53. The shield assembly as recited in claim 51, wherein the second jaw is translatable relative to the first jaw.

* * * * *